US005411800A

United States Patent [19]

Yokoe et al.

[11] Patent Number: 5,411,800

[45] Date of Patent: May 2, 1995

[54] DOLL'S HAIR

[75] Inventors: Masaaki Yokoe, Kakogawa; Hiroshi Yokoyama, Akashi; Yoshinori Kashita, Akashi, all of Japan

[73] Assignee: Kanegafuchi Kagaku Kogyo Kabushiki Kaisha, Osaka, Japan

[21] Appl. No.: 948,479

[22] Filed: Sep. 22, 1992

Related U.S. Application Data

[62] Division of Ser. No. 780,517, Oct. 22, 1991, abandoned.

[30] Foreign Application Priority Data

Oct. 27, 1990 [JP] Japan ..... 2-290515

[51] Int. Cl.[6] ..... A63H 3/44; D06M 15/00; D06M 101/16

[52] U.S. Cl. ..... 428/362; 428/375; 446/268

[58] Field of Search ..... 132/53; 428/362, 375; 446/268; 424/70, 71

[56] References Cited

U.S. PATENT DOCUMENTS 3,949,764 4/1976 Scott ..... 132/7
4,382,111 5/1983 Kuwayama et al. ..... 428/395

FOREIGN PATENT DOCUMENTS 9117959 10/1962 European Pat. Off. .
2042352 9/1980 United Kingdom .

*Primary Examiner*—Patrick J. Ryan
*Assistant Examiner*—Richard C. Weisberger
*Attorney, Agent, or Firm*—Armstrong, Westerman, Hattori, McLeland & Naughton

[57] ABSTRACT

A doll's hair comprising synthetic fibers to which a water repellent is applied, said fiber having such a water repellency that when a liquid droplet of 20% by weight aqueous isopropyl alcohol solution is placed on the bundle of said fibers, the droplet is kept as it is for not less than one minute on the bundle. Since the doll's hair comprises the fibers having the excellent water repellency, even if a child plays at a doll in a bathroom, for instance, she dips the doll in water, and combs or shampoos the hair, water can be easily removed from the hair, and the original hairstyle can be quickly restored.

9 Claims, 6 Drawing Sheets

DOLL'S HAIR

This application is a divisional of USSN 07/780,517, filed Oct. 22, 1991, now abandoned.

BACKGROUND OF THE INVENTION

The present invention relates to doll's hair and more particularly to doll's hair having an excellent water repellency. In a case that a child plays with a doll in a bathroom, for instance, she dips a doll in warm water and combs or shampoos the doll's hair. When the doll's hair of the present invention is used, water can be easily removed from the wet hair and the hair can be easily dried. Accordingly, the doll can be easily restored to the original hairstyle. The doll's hair of the present invention has the thus novel function.

In one of the playing manners by children, using dolls, a child takes a bath together with a doll and she often plays with a doll, for instance, combs or shampoos the doll's hair. Particularly, a doll has, recently, been prepared from a material containing a heat sensitive color-forming material wherein a color reversibly formed and disappears depending on a temperature. Accordingly, the above-mentioned playing manner is carried out very often.

Doll's hair has hitherto been prepared from synthetic fibers such as nylon fibers, polypropylene fibers, polyvinyl chloride fibers, polyvinylidene fibers or modacrylic fibers. Thus doll's hair gets easily wet, so if the doll is dipped in water, a large amount of water remains in spaces formed between the hairs after taking it out from the bath. Even if the head is swished for swishing off water from the hair, the hairs are stuck together to form a close-packed state and it is easy to break out the hairstyle. Also, if the wet doll's hair is combed, the curled hairs are easily straightened, because the hairs are stretched in one direction, and owing to the weight of the hair containing a large amount of water. The thus treated doll's hair cannot be restored to the original hairstyle even if the hair is dried.

An object of the present invention is to provide doll's hair having a characteristic such that even if a child dips a doll in warm water and combs or shampoos the doll's hair, water can be easily removed from the hair and the hair is quickly dried to restore the original hairstyle.

This and other objects of the present invention will become apparent from the description hereinafter.

SUMMARY OF THE INVENTION

It has now been found that when synthetic fibers which have hitherto been used are specifically treated with a water repellent, the obtained fibers can attain the above-mentioned objects.

In accordance with the present invention, there is provided doll's hair comprising synthetic fibers to which a water repellent is applied, the fiber having such a water repellency that when a liquid droplet of 20% by weight aqueous isopropyl alcohol solution is placed on the bundle of the fibers, the droplet is kept as it is for not less than one minute on the bundle.

DETAILED DESCRIPTION

Figure 1:
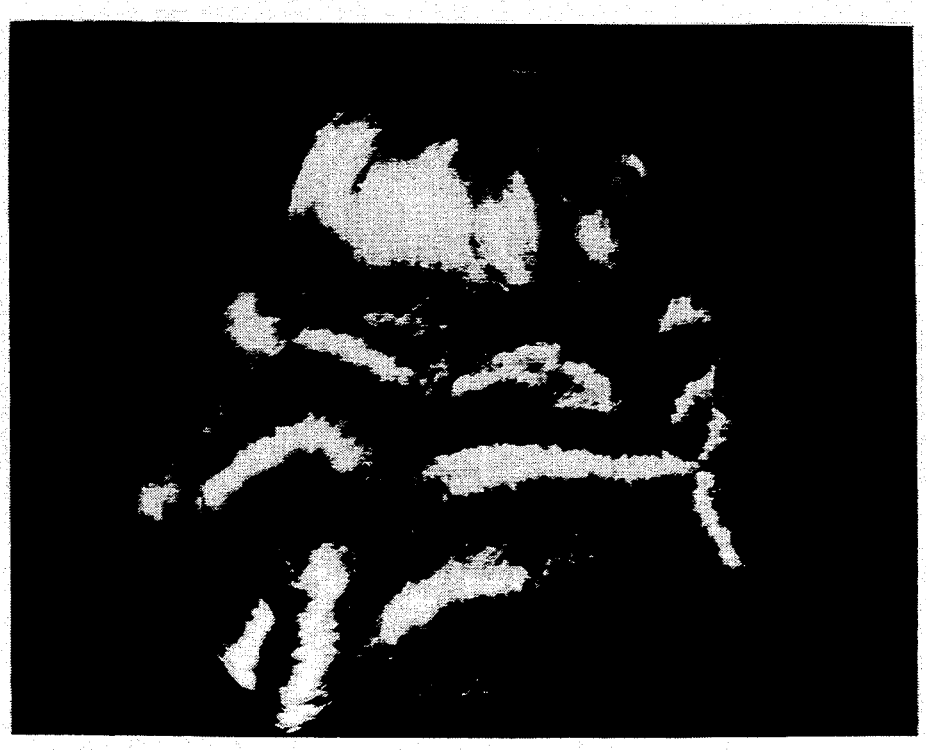
FIG. 1 is a photograph showing a state of doll's hair obtained in Example 1 before dipping the hair in water.

In the present invention, any synthetic fiber from which doll's hair is prepared can be used. Examples of the fibers are, for instance, nylon fibers, polypropylene fibers, polyvinyl chloride fibers, polyvinylidene fibers, roodacrylic fibers, acrylic fibers, polyester fibers, and the like. Among them, there are preferable the modacrylic fibers, the polyvinylidene chloride fibers, the polyvinyl chloride fibers and the polypropylene fibers from the viewpoint of the curl retention. Examples of the polyvinylidene chloride fibers are, for instance a fiber of vinylidene chloride homopolymer, a fiber of a copolymer comprising not less than 80% by weight of vinylidene chloride and vinyl chloride, and the like. Example of the vinyl chloride fibers are, for instance, a fiber of vinyl chloride homopolymer, a fiber of copolymer comprising not less than 80% by weight of vinyl chloride and other monomers copolymerizable therewith, and the like. Examples of the modacrylic fibers are, for instance, a fiber of a copolymer comprising 30 to 80% by weight of acrylonitrile and 70 to 20% by weight of at least one of vinyl chloride and vinylidene chloride, and the like.

In order to utilize the synthetic fibers as the doll's hair, it is preferable that the hair is prepared from a multiplicity of multifilaments having a fineness of 200 to 2,000 deniers, and each having monofilaments with a fineness of 10 to 150 deniers.

In the present invention, the synthetic fibers are treated with a water repellent. Examples of the water repellents are, fluorine water repellents, silicone water repellents, zirconium soap, and the like. The water repellent may be used alone or as a mixture thereof. Particularly, the fluorine water repellents and the silicone water repellents are preferable, because they have the excellent water repellency, namely a water repellency as estimated by the following method of not less than one minute. Examples of the fluorine water repellents are, for instance, fluoroalkyl group-containing water repellents, and the like. Among them, there are preferable polymers of acrylate or methacrylate containing a fluoroalkyl group with 3 to 20, preferably 4 to 15 carbon atoms, such as $CF_3(CF_2)_7(CH_2)_2OCOCH{=}CH_2$, $CF_3(CF_2)_4CH_2OCOC(CH_3){=}CH_2$, $(CF_3)_2CF(CF_2)_{10}(CH_2)_3OCOCH{=}CH_2$ or $(CF_3)_2CF(CF_2)_6CH_2CH(OCOCH_3)OCO(CH_3){=}CH_2$.

Examples of the silicone water repellents are, for instance, methyl hydrogenpolysiloxane, amino-modified polysiloxane, dimethylpolysiloxane having OH-terminal group, and the like.

The water repellent is used in an amount of not less than 0.05% by weight, preferably not less than 0.1% by weight, based on the weight of the fibers. Although the more the amount of the water repellent, the more excellent the water repellency, the use of the excessive amount of the water repellent impairs the feeling to the touch. Accordingly, it is preferable that the amount of the water repellent is not more than 5% by weight based on the weight of fibers.

As a manner for giving the water repellency to synthetic fiber hair, any manner can be conducted. The water repellent is applied to the synthetic fiber in the preparation process of the fiber. For instance, it is general that the fibers are dipped in, or coated or sprayed with an aqueous solution of the water repellent, for example in an apparatus for applying a surfactant to the fiber. Then, it is preferable that the coated the water repellent are pre-dried at 80° to 130° C. and cured at 130° to 160° C., thus, the durability of water repellency is improved, in the cases of using the fluorine water repellent and the silicone water repellent. Also, it is possible that the water repellent is applied to the synthetic fibers rooted on the doll's head according a post-treatment, for instance, by dipping the hair the aqueous solution of the water repellent, spraying or coating the hair with the aqueous solution of the water repellent, or the like.

The water repellency of the synthetic fibers formed into the doll's hair is estimated as follows:

A liquid droplet (0.03 ml) of an aqueous solution containing 20% by weight of isopropyl alcohol is placed gently at 20 ° C. on a bundle of dose-packed fibers having no space between the fibers (fineness: about 300,000 denier) straightened in a straight line, and the length of time until the liquid droplet begins to penetrate into the bundle, in other words, the length of time that the liquid droplet is kept as it is on the bundle is measured. The longer the length of time, the more excellent the water repellency of the fiber. In the present invention, the fibers are required to have the length of time of not less than one minute. It is preferable that the length of time is not less than three minutes, more preferably not less than five minutes. When the length of time is less than one minute, the fibers of the hair are stuck together to form a dose-packed state and the cured hairs play out to their full length, thus the doll cannot restore to the original hairstyle, because it is difficult to remove water from such fibers and it takes a long time to dry the hair.

After the water repellent is applied to the synthetic fibers, the fibers are continuously cured.

The present invention is more specifically described and explained by means of the following Examples in which all percents and parts are by weight unless otherwise noted. It is to be understood that the present invention is not limited to the Examples, and various changes and modifications may be made in the invention without departing from the spirit and scope thereof.

Example 1

A commercial water repellent containing a fluoroalkyl group-containing water repellent as a main component was applied to roodacrylic fibers (each fiber: 1100 denier- 36 monofilaments) in an amount of 0.4% of the fibers.

The water repellency of the obtained roodacrylic fiber was measured as mentioned above. The length of time was not less than five minutes.

The roodacrylic fibers were continuously curled and rooted on a doll's head made from a polyvinyl chloride.

After the hairstyle was arranged by using a brush, the doll's head was dipped in warm water having a temperature of 40° C. and the hair was washed by combing ten times in water. Then, the head was swished 5 times and the hair was toweled. Moisture adhered to the hair in a slight amount and the amount was 11% based on the weight of the hair.

Figure 4:
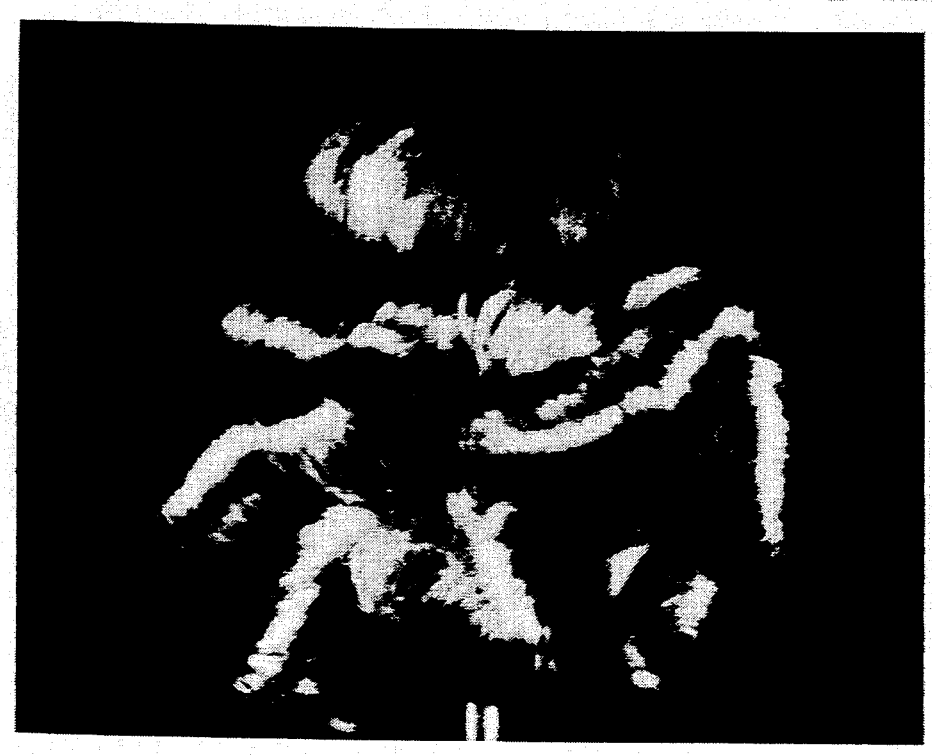
FIG. 4 is a photograph showing a state of doll's hair obtained in Example 1 after washing the hair in water, swishing the doll ° s head and towelling the hair.

FIG. 1 is a photograph showing the state of the doll's hair before dipping the hair in water, and FIG. 4 is a photograph showing the state of the doll's hair after dipping the hair in water, swishing the doll's head and towelling the hair. As shown in FIG. 4, the fibers were not stuck together to form a close-packed state and the curls were kept original. Accordingly, the original hairstyle could be easily restored.

Example 2

A mixture of commercial water repellent containing methyl hydrogenpolysiloxane as a main component and Zn soap as a catalyst was applied to polyvinylidene chloride fibers (each fiber: 1000 denier - 20 monofilaments) in an amount of 0.6% of the fibers, and the fibers were subjected to heat-treatment.

The water repellency of the obtained polyvinylidene chloride fiber was measured as mentioned above. The length of time was not less than five minutes.

The polyvinylidene chloride fibers were continuously curled and rooted on a doll's head made from a polyvinyl chloride.

Then, the procedure of Example 1 was repeated. Moisture adhered to the hair in an amount of 9% based on the weight of the hair, in other words, the hair was in the substantially dried state. The fibers were not stuck together to form a close-packed state and the curls were kept original. Accordingly, the original hairstyle could be easily restored.

Comparative Example 1

Nylon fibers (each fiber: 1200 denier - 24 monofilaments) which were not applied to a water repellent, were continuously curled and rooted on a doll's head made from a polyvinyl chloride.

The water repellency of the nylon fiber was measured as mentioned above. The length of time was less than one second.

Then, the procedure of Example 1 was repeated. Moisture adhered to the hair in a large amount compared to the hairs of Examples 1 and 2, namely, 31% based on the weight of the hair.

Figure 2:
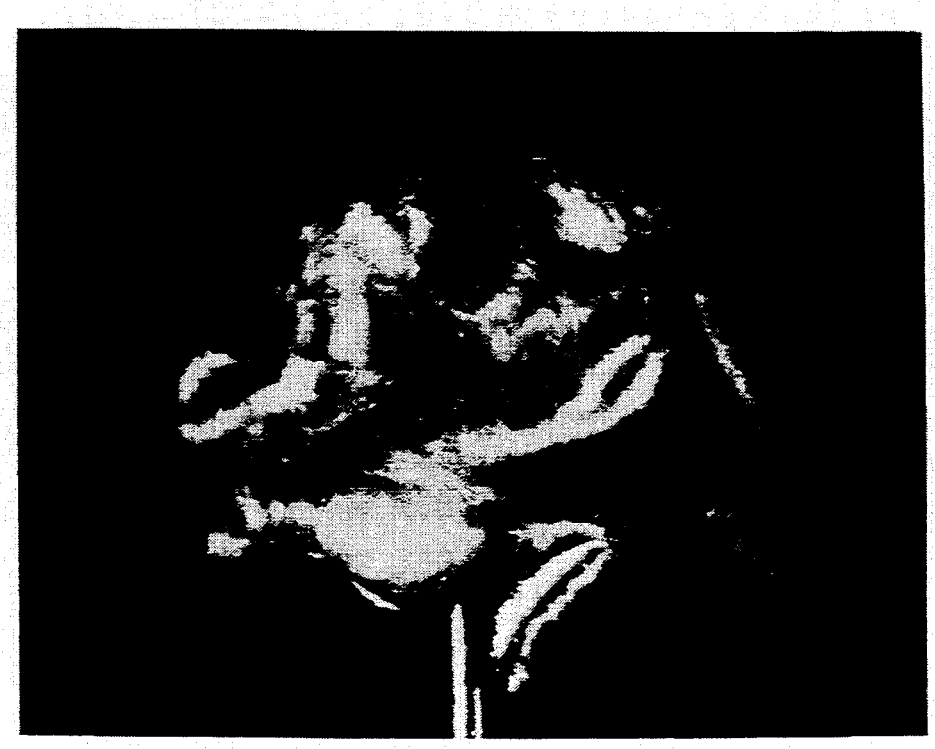
FIG. 2 is a photograph showing a state of doll's hair used in Comparative Example 1 before dipping the hair in water.
Figure 5:
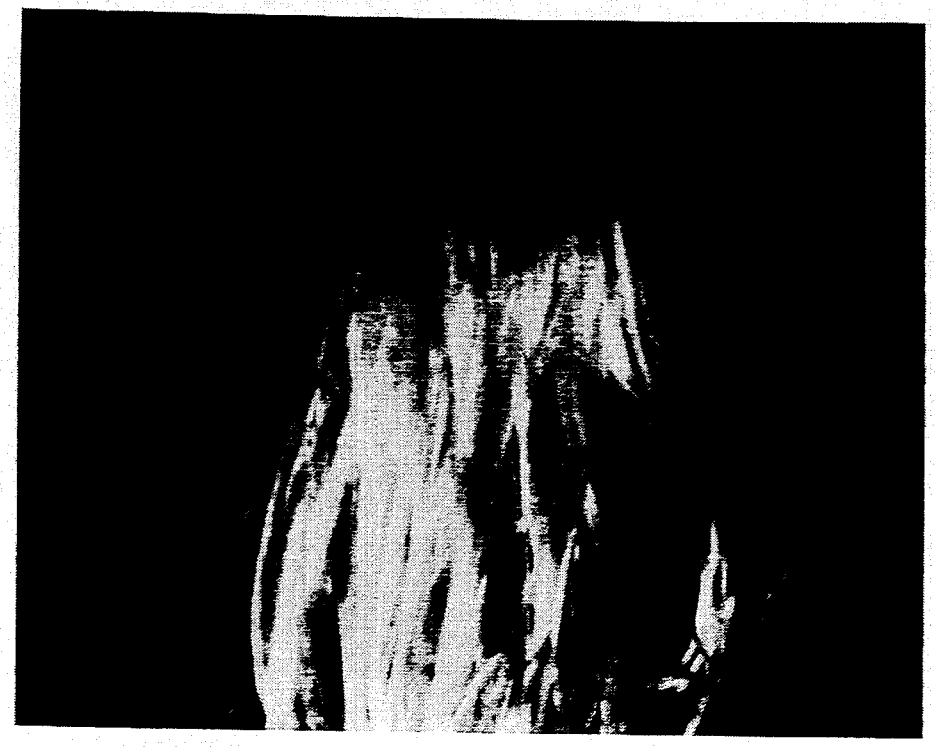
FIG. 5 is a photograph showing a state of doll's hair used in Comparative Example 1 after washing the hair in water, swishing the doll's head and towelling the hair.

FIG. 2 is a photograph showing the state of the doll's hair before dipping the hair in water, and FIG. 5 is a photograph showing the state of the doll's hair after dipping in water, swishing the doll's head and towelling the hair. As showing in FIG. 5, the fibers were stuck together to form a close-packed state and the curls were prolonged by the weight of the hair containing water. Accordingly, the original hairstyle could not be restored.

Comparative Example 2

The same polyvinylidene chloride fibers used in Example 2 (each fiber: 1000 denier - 20 monofilaments) to which a water repellent was not applied, were continuously curled and rooted on a doll's head made from a polyvinyl chloride.

The water repellency of the polyvinylidene chloride fiber was measured as mentioned above. The length of time was less than one second.

Then, the procedure of Example 1 was repeated. Moisture adhered to the hair in a large amount compared to the hairs of Examples 1 and 2, namely, 25% based on the weight of the hair.

Figure 3:
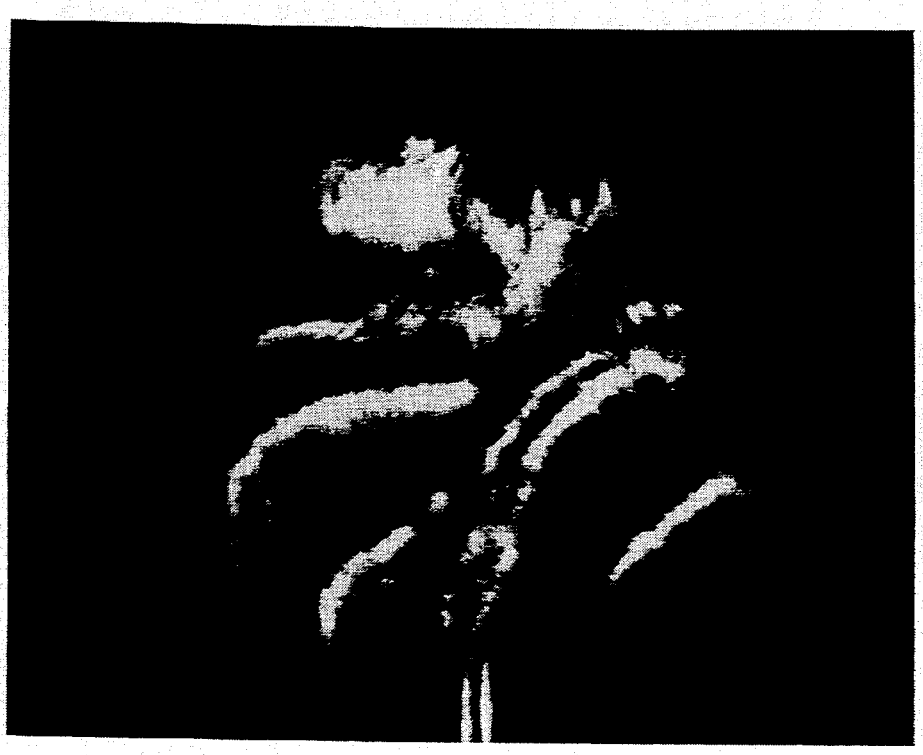
FIG. 3 is a photograph showing a state of doll's hair used in Comparative Example 2 before dipping the hair in water.
Figure 6:
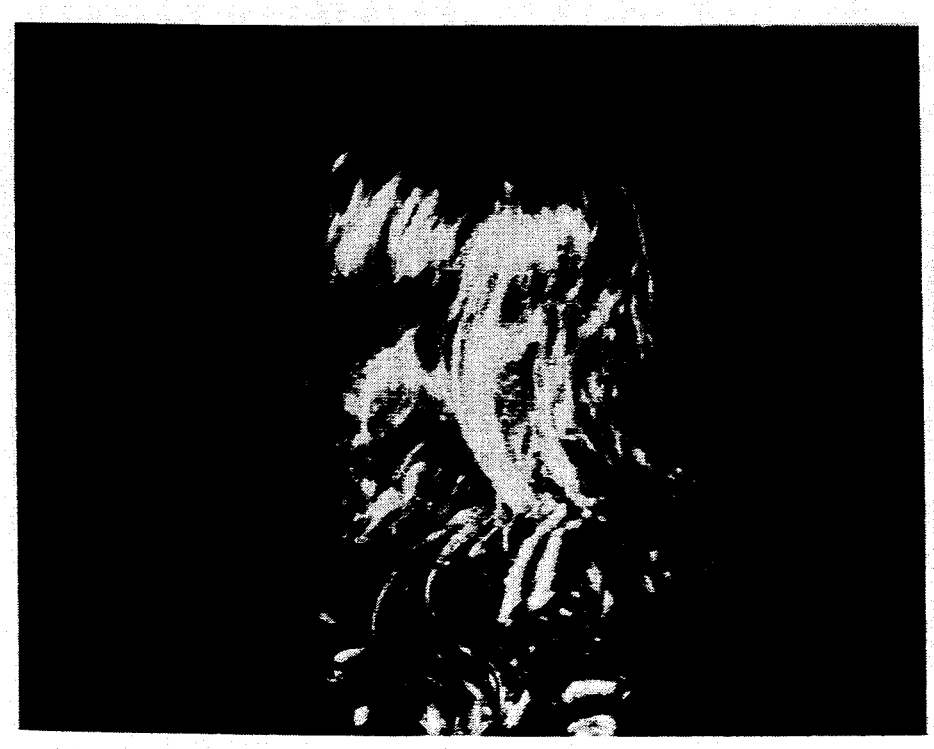
FIG. 6 is a photograph showing a state of doll's hair obtained in Comparative Example 2 after washing the hair in water, swishing the doll's head and towelling the hair.

FIG. 3 is photograph showing the state of the doll's hair before dipping the hair in water, and FIG. 6 is a photograph showing the state of the doll's hair after dipping in water, swishing the doll's head and towelling the hair. As shown in FIG. 6, the fibers were stuck together to form a close-packed state and the curls were prolonged by the weight of the hair containing water. Accordingly, the original hairstyle could not be restored.

Since the doll's hair of the present invention is prepared from the synthetic fibers having the excellent water repellency, even if a child plays with a doll in, a bathroom, for instance, she dips the doll in warm water and combs or shampoos the doll's hair, water can be easily removed from the hair by taking out from the bath and swishing the head, and the hair can be easily dried. Accordingly, a large amount of water is not contained in spaces formed between the hairs, the hairs are not stuck together to form a close-packed state or the curled hairs are not straightened by the weight of water contained in the spaces formed between the hairs, differing from the conventional hair. Accordingly, the original hairstyle can be quickly restored after swishing off water.

In addition to the ingredients used in the Examples, other ingredients can be used in the Examples as set forth in the specification to obtain substantially the same results.

What we claim is:

1. A doll having hair comprising synthetic fibers to which a water repellent is applied, said fiber having such a water repellency that when a liquid droplet of 20% by weight aqueous isopropyl alcohol solution is placed on the bundle of said fibers, the droplet is kept as it is for not less than one minute on the bundle.

2. The doll of claim 1, wherein said fiber has a water repellency such that the droplet is kept on the bundle for not less than 3 minutes.

3. The doll of claim 1, wherein said fiber has a water repellency such that the droplet is kept on the bundle for not less than 5 minutes.

4. The doll of claim 1, wherein said fiber is a member selected from the group consisting of a modacrylic fiber, a polyvinylidene chloride fiber, a polyvinyl chloride fiber and a polypropylene fiber.

5. The doll of claim 1, wherein said fiber is treated with a water repellent selected from the group consisting of a fluorine water repellent, a silicone water repellent and a zirconium soap.

6. The doll of claim 1, wherein said fiber is treated with a fluoroalkyl group-containing water repellent.

7. The doll of claim 6, wherein said water repellent is a polymer of an acrylate or methacrylate having a $C_3$ to $C_{20}$ fluoroalkyl group.

8. The doll of claim 6, wherein said water repellent is a polymer of a fluoroalkyl acrylate or methacrylate selected from the group consisting of $CF_3(CF_2)_7(CH_2)_2OCOCH{=}CH_2$, $CF_3(CF_2)_4CH_2OCOC(CH_3){=}CH_2$, $(CH_3)_2CF(CF_2)_{10}(CH_2)_3OCOCH{=}CH_2$ and $(CF_3)_2CF(CF_2)_6CH_2CH(OCOCH_3)OCO(CH_3){=}CH_2$.

9. The doll of claim 1, wherein said fiber is treated with a silicone water repellent selected from the group consisting of methyl hydrogenpolysiloxane, an amino-modified polysiloxane, and an OH-terminated dimethylpolysiloxane.

* * * * *